US009434508B2

(12) United States Patent
Su et al.

(10) Patent No.: US 9,434,508 B2
(45) Date of Patent: Sep. 6, 2016

(54) EXHIBITING CONTAINER FOR FASTENERS

(71) Applicant: TAIWAN SHAN YIN INT'L CO., LTD., Kaohsiung (TW)

(72) Inventors: Kou-Tsair Su, Kaohsiung (TW); Yu-Jung Su, Kaohsiung (TW)

(73) Assignee: Taiwan Shan Yin Int'l Co., Ltd., Kaohsiung (TW)

( * ) Notice: Subject to any disclaimer, the term of this patent is extended or adjusted under 35 U.S.C. 154(b) by 31 days.

(21) Appl. No.: 14/334,752

(22) Filed: Jul. 18, 2014

(65) Prior Publication Data

US 2016/0009449 A1 Jan. 14, 2016

(51) Int. Cl.

| | |
|---|---|
| ***B65D 71/00*** | (2006.01) |
| ***B65D 21/02*** | (2006.01) |
| ***B65D 23/10*** | (2006.01) |
| ***B65D 47/08*** | (2006.01) |
| ***B65D 47/28*** | (2006.01) |

(52) U.S. Cl.

CPC ..... *B65D 21/0219* (2013.01); *B65D 21/022* (2013.01); *B65D 23/102* (2013.01); *B65D 47/0852* (2013.01); *B65D 47/286* (2013.01)

(58) Field of Classification Search

USPC ..... 206/338, 340

See application file for complete search history.

(56) References Cited

U.S. PATENT DOCUMENTS

| | | | | |
|---|---|---|---|---|
| 6,460,718 | B1 * | 10/2002 | Vogel | B65D 21/0219 206/508 |
| 6,983,862 | B2 * | 1/2006 | Nottingham | B67D 1/16 206/508 |
| 7,040,509 | B2 * | 5/2006 | McLelland | B44D 3/12 206/508 |
| 2003/0221987 | A1 * | 12/2003 | Trude | B65D 1/0276 206/508 |
| 2007/0114200 | A1 * | 5/2007 | Lane | B65D 1/023 215/10 |
| 2007/0138045 | A1 * | 6/2007 | Miller | B65D 1/0261 206/508 |
| 2014/0061086 | A1 * | 3/2014 | Park | B65D 17/165 206/508 |

* cited by examiner

*Primary Examiner* — Jacob K Ackun

(74) *Attorney, Agent, or Firm* — Alan D. Kamrath; Kamrath IP Lawfirm, P.A.

(57) ABSTRACT

An exhibiting container for fasteners includes at least one holding portion formed on an outer circumference of a body portion of a bottle, a lodging zone recessed into a bottom of the bottle, an opening formed on a cap for communicating with an outside and an accommodating space of the body portion, and at least one connecting unit formed on the cap for fitting in with and inserting into the lodging zone. Accordingly, the exhibiting container is held easily by using the holding portion. With the matching cooperation of the lodging zone and the connecting unit, a plurality of exhibiting containers is firmly piled up and is not blocked off with each other, whereby fasteners stored in the exhibiting container are exhibited entirely. The opening allows users to take the fasteners out of the accommodating space directly and easily, which increases the convenience of use efficiently.

3 Claims, 9 Drawing Sheets

EXHIBITING CONTAINER FOR FASTENERS

BACKGROUND OF THE INVENTION

1. Field of the Invention

The present invention relates to an exhibiting container and, particularly, to an exhibiting container for fasteners which can be held with ease, which allows multiple exhibiting containers to be piled and positioned one above another firmly for exhibiting the inside fasteners entirely, and which allows users to take out the fasteners simply.

2. Description of the Related Art

Referring to FIG. 1, a conventional container 1 for fasteners comprises a bottle 11 for storing fasteners (not shown) and a cap 12 rotationally engaged with the bottle 11. In use, users merely hold the container 1 by grasping the entire bottle 11, but the bottle 11 with a smooth surface usually causes an inconvenience while holding. Further, if multiple containers 1 are piled as shown in FIG. 2, the whole container 1 (i.e. the bottle 11 and the cap 12) with the smooth surface may fall or may be piled out of alignment by a push of an external force, which causes the containers 1 unable to be piled firmly and straight and decreases the whole look of exhibition of the inside fasteners.

Therefore, another container 2 is invented to overcome the drawbacks of the conventional container 1. Referring to FIG. 3, a conventional container 2*a* comprises a bottle 21*a* and a cap 22*a* disposed on the bottle 21*a*. A recess 221*a* with a certain depth is formed on the cap 22*a*. When two containers 2*a*, 2*b* are piled up, a bottom of the bottle 21*a* of one container 2*a* can be placed into the recess 221*b* of the cap 22*b* of another container 2*b* for achieving a piling effect.

However, the container 2 still has some problems:

1. Because the recess 221*b* of the cap 22*b* is formed with the certain depth, the partial bottle 21*a* of the container 2*a* (as shown in broken lines) is inevitably blocked off by the cap 22*b* of the other container 2*b* while the bottom of the bottle 21*a* of the container 2*a* is placed into the recess 221*b* of the other container 2*b*, which causes fasteners (not shown) stored in the container 2*a* to be shown incompletely and causes inconveniences of exhibition and sale.

2. With respect to either container, such as the container 2*b*, because the cap 22*b* is disposed on the bottle 21*b* for closing the bottle 21*b*, users need to remove the entire cap 22*b* from the bottle 21*b* first and take the fasteners out of the bottle 21, which not only causes the inconvenience of use but also requires more time on taking the fasteners out. It may also have the problem that the cap 22*b* taken away from the bottle 21*b* gets lost incautiously. Consequently, the container 2 still needs improvements.

SUMMARY OF THE INVENTION

Accordingly, the objects of the present invention are to provide an exhibiting container for fasteners that allow multiple containers to be piled up firmly without blocking off each other to exhibit the inside fasteners completely and allow users to hold the exhibiting container easily and take out the fasteners simply to increase the convenience of use effectively.

The exhibiting container for fasteners in accordance with the present invention comprises a bottle and a cap connected to the bottle. The bottle includes a top, a body portion connected to the top and a bottom connected to the body portion. A mouth is enclosed on the top of the bottle for communicating with an outside, and an accommodating space is formed in an interior of the body portion and communicating with the mouth, whereby fasteners are stored in the accommodating space. At least one holding portion is formed on an outer circumference of the body portion, and a lodging zone is recessed into the bottom. An opening is formed on the cap for communicating with the mouth and the outside, and at least one connecting unit is convexly disposed on the cap for inserting into the lodging zone. Accordingly, users can hold the container easily by the holding portion and can pile a plurality of containers up firmly by embedding the connecting unit of one exhibiting container into the lodging zone of another exhibiting container. Simultaneously, the whole appearance of the bottle of the exhibiting container is not blocked off by the cap of the other exhibiting container for exhibiting the inside fasteners entirely. In addition, the opening is formed for allowing users to take the fasteners out of the exhibiting container directly and conveniently, which increases the convenience of use.

Preferably, the cap includes a cap body by which the opening is enclosed and at least one lid pivotally disposed on the cap body for closing the opening and isolating the opening from the outside, a lodging part is formed on a circumference of the lid, and a flange fitting in with a dimension of the lodging part is disposed on a circumference of the cap body.

Preferably, the cap body and the lid have respective connecting units disposed thereon.

Preferably, the connecting unit is convexly disposed on the lid.

Preferably, the cap includes the cap body by which the opening is enclosed and a sliding lid slidably disposed on the cap body for closing the opening and isolating the opening from the outside, two tracks are respectively disposed on the cap body for allowing the sliding lid to slide thereon, and the connecting unit is convexly disposed on a top surface of the sliding lid.

Preferably, the sliding lid provides a plurality of auxiliary grooves formed on the top surface thereof.

Preferably, a stopping unit is disposed at a bottom surface of the sliding lid.

The advantages of the present invention over the known prior art will become more apparent to those of ordinary skilled in the art upon reading the following descriptions in junction with the accompanying drawings.

DETAILED DESCRIPTION OF THE PREFERRED EMBODIMENTS

Figure 1:
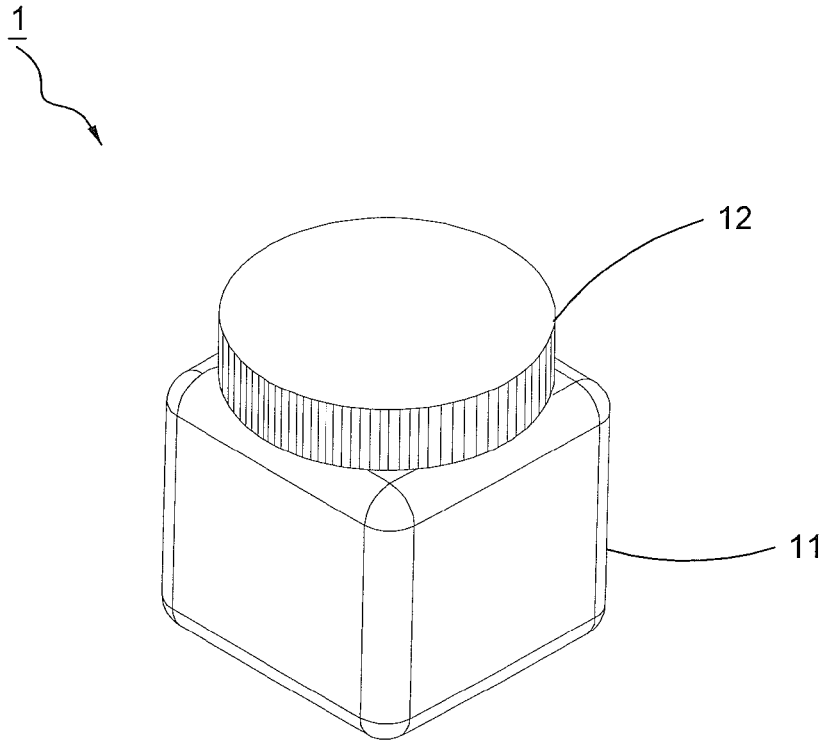
FIG.1 (PRIOR ART)
FIG. 1 is a schematic view showing a conventional container 1 for fasteners.
Figure 2:
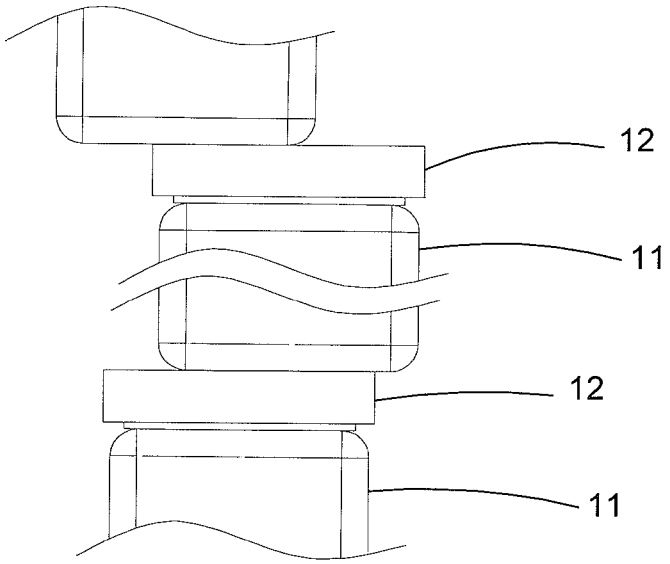
FIG.2 (PRIOR ART)
FIG. 2 is a schematic view showing the conventional container 1 for fasteners in a state of being piled up.
Figure 3:
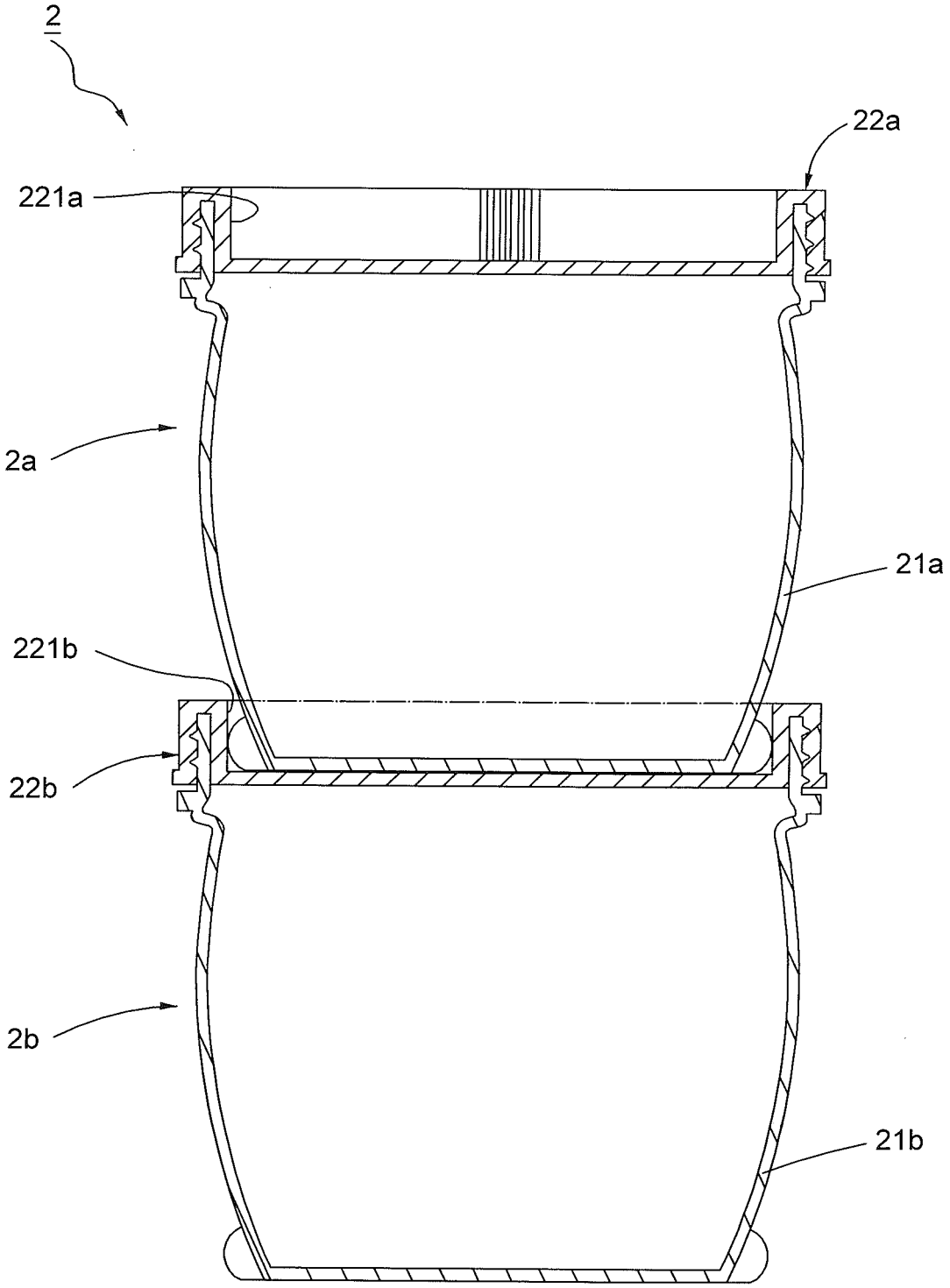
FIG.3 (PRIOR ART)
FIG. 3 is a schematic view showing another conventional container 2 in a state of being piled up.
Figure 4:
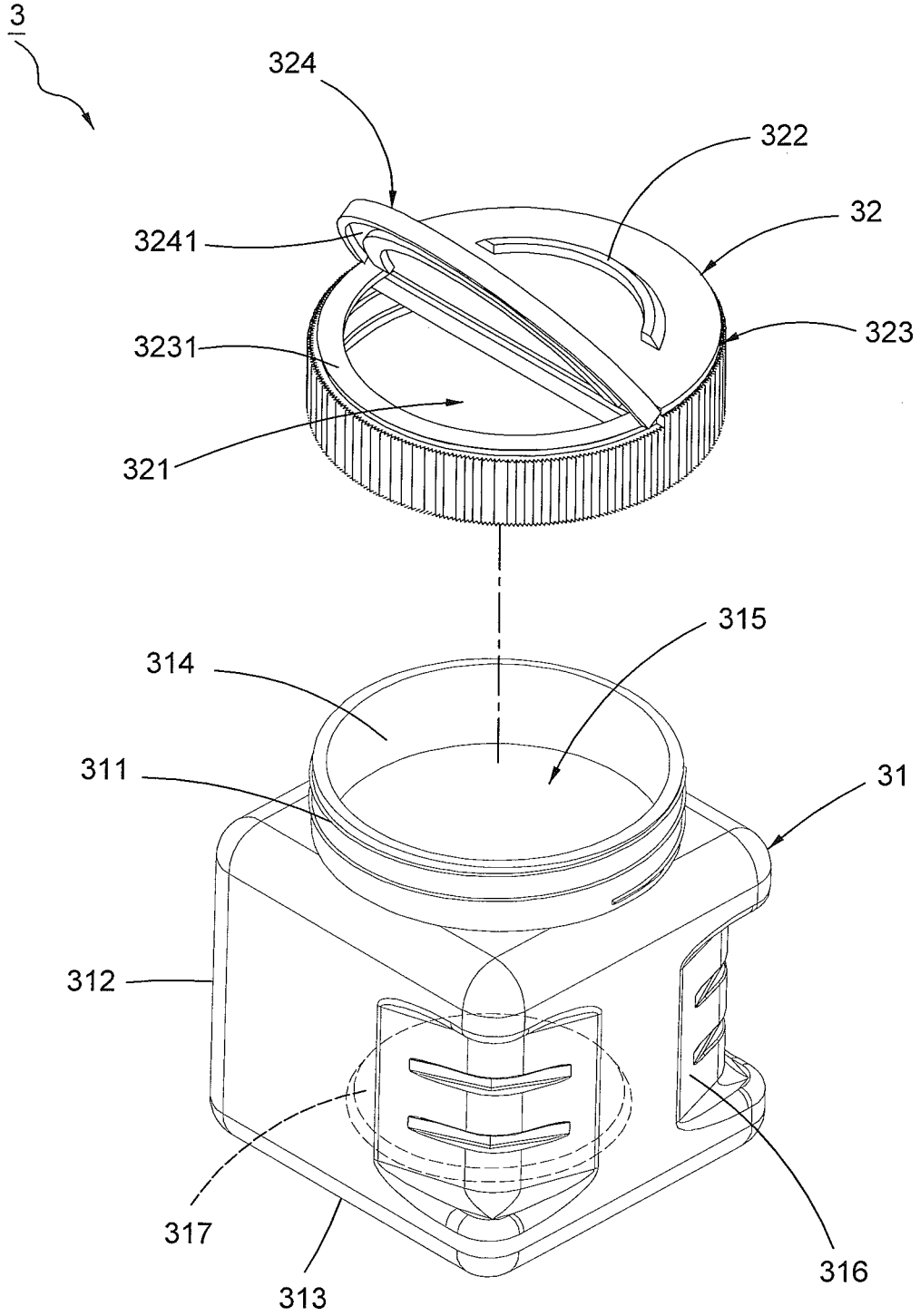
FIG. 4 is a perspective view showing a first preferred embodiment of the present invention.
Figure 5:
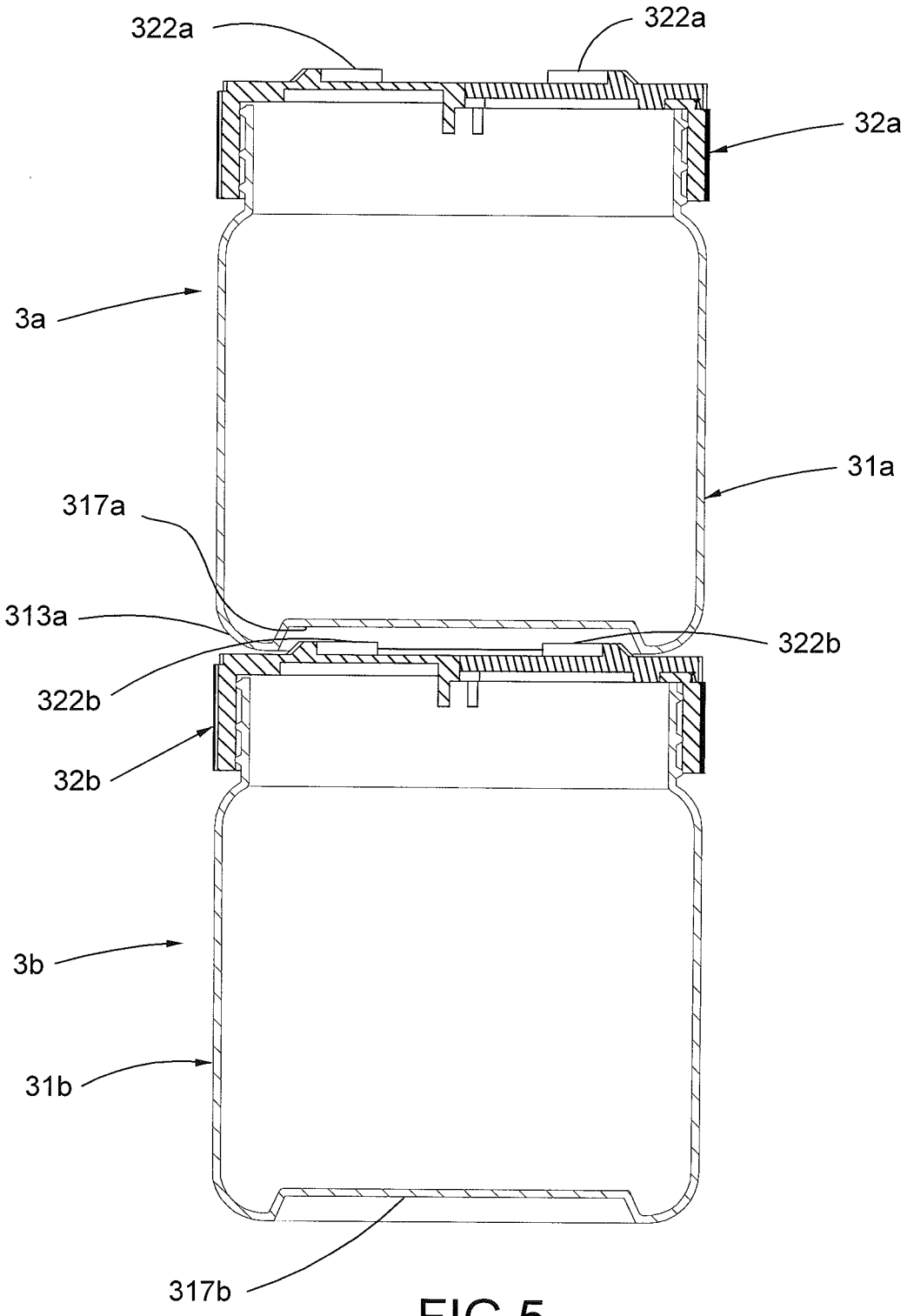
FIG. 5 is a schematic view showing the first preferred embodiment of the present invention in a state of being piled up.

Referring to FIGS. 4 and 5, a first preferred embodiment of the exhibiting container 3 for fasteners comprises a bottle 31 and a cap 32 connected to the bottle 31. The bottle 31 includes a top 311, a body portion 312 connected to the top 311 and a bottom 313 connected to the body portion 312. A mouth 314 is enclosed on the top 311 of the bottle 31, and an accommodating space 315 is formed in an interior of the body portion 312 and communicating with the mouth 314, whereby fasteners (not shown) are stored in the accommodating space 315. The cap 32 is connected to the top 311 and set at the mouth 314, whereby the accommodating space 315 is opened or closed according to an operation of the cap 32. At least one holding portion 316 is disposed on an outer circumference of the body portion 312 for hands to hold. A lodging zone 317 is recessed into the bottom 313 of the bottle 31. An opening 321 is formed on the cap 32 for communicating with the mouth 314 and an outside. At least one connecting unit 322 is convexly disposed on the cap 32 for inserting into the lodging zone 317, whereby a plurality of exhibiting containers 3*a*, 3*b* can be piled and positioned one above another by embedding the connecting unit 322*b* of the exhibiting container 3*b* into the lodging zone 317*a* of the exhibiting container 3*a*, which allows the bottom 313*a* of the bottle 31*a* of the exhibiting container 3*a* to be positioned safely onto the cap 32*b* of the other exhibiting container 3*b*, and which prevents the whole bottle 31*a* of the exhibiting container 3*a* from being blocked off by the cap 32*b* of the other exhibiting container 3*b* in the piled state.

Figure 6:
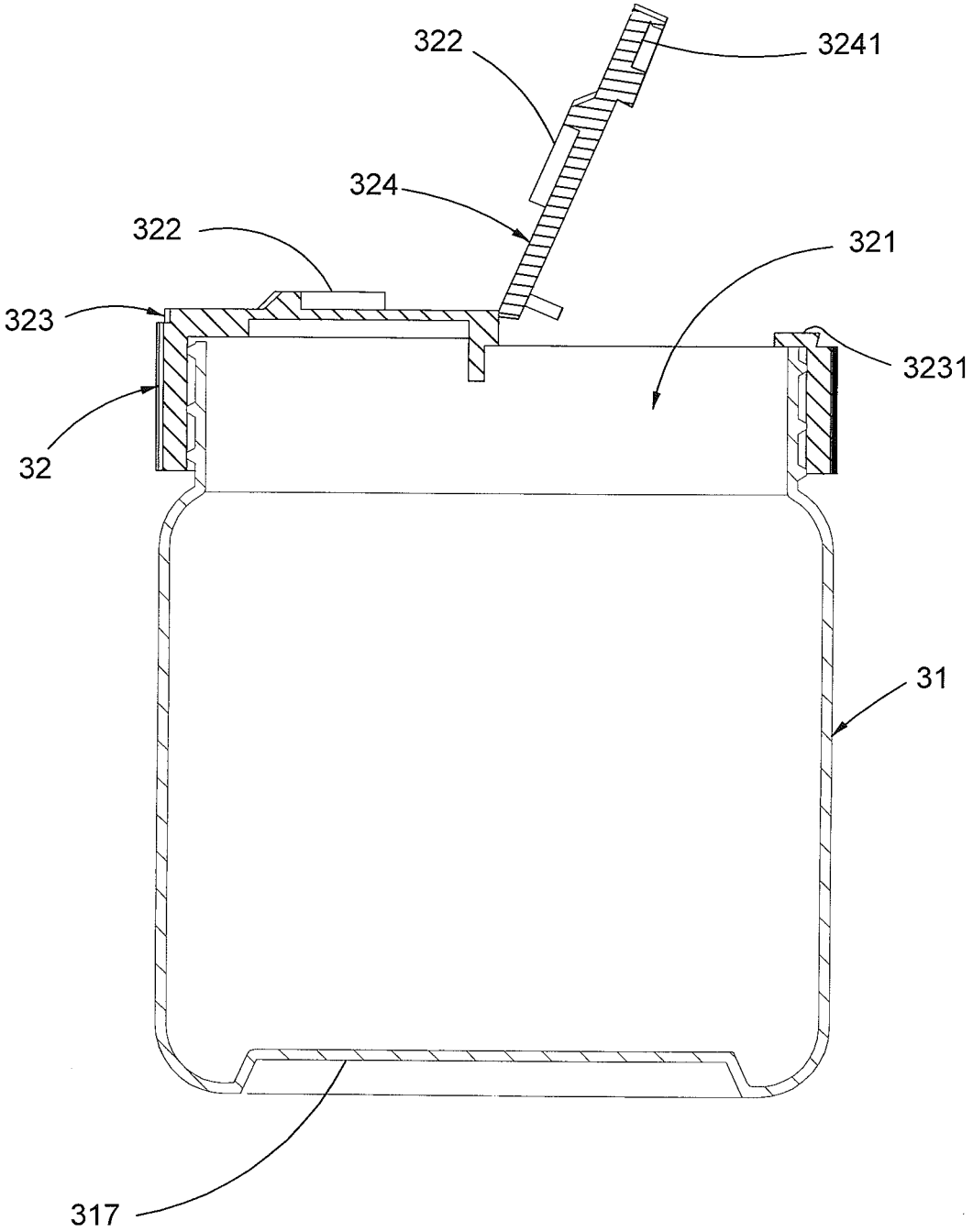
FIG. 6 is a schematic view showing the first preferred embodiment of the present invention with its lid being opened.
Figure 9:
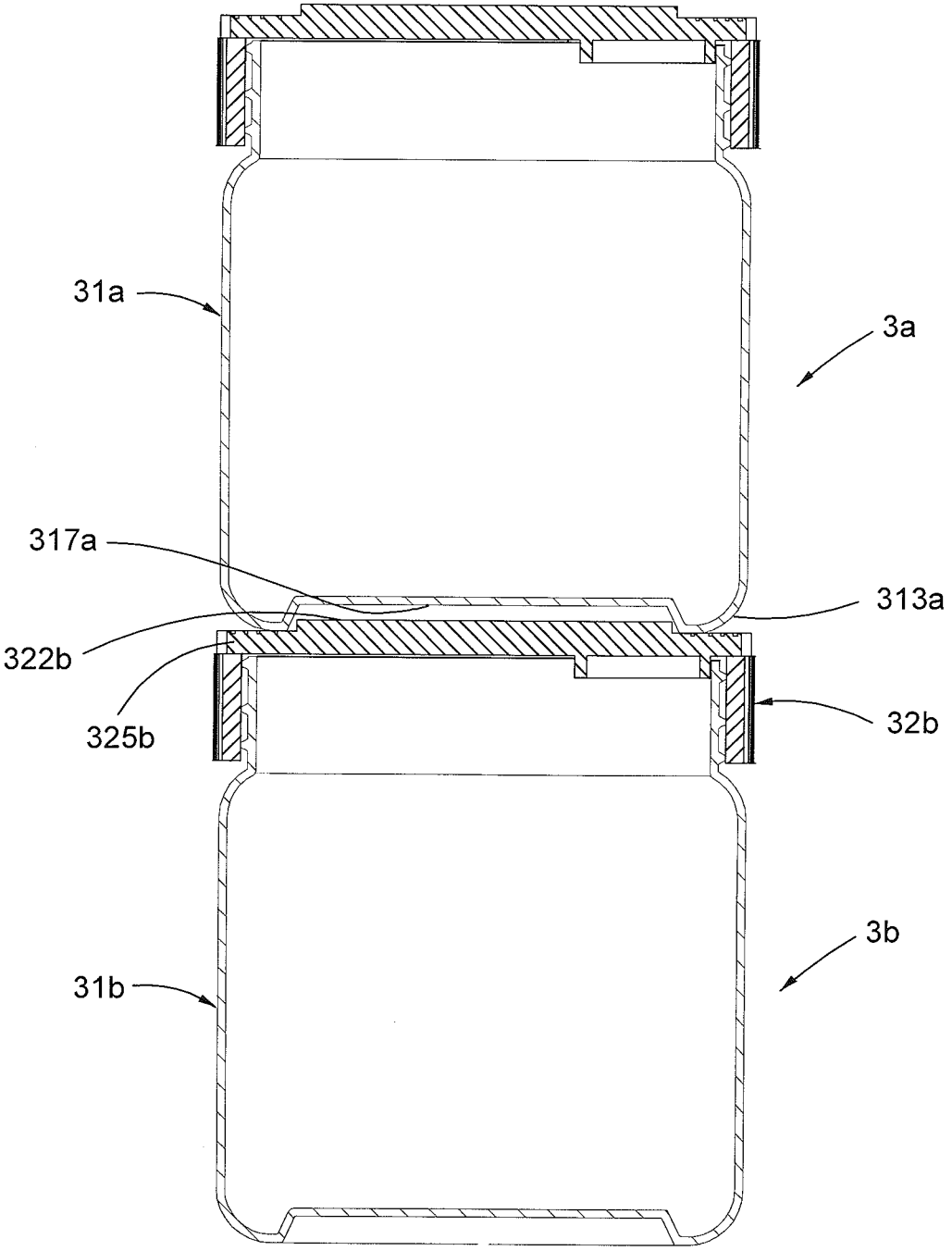
FIG. 9 is a schematic view showing the second preferred embodiment of the present invention in a state of being piled up.

Furthermore, the cap 32 provides a cap body 323 by which the opening 321 is enclosed and at least one lid 324 pivotally disposed on the cap body 323 for closing the opening 321 and isolating the opening 321 from the outside. A lodging part 3241 is formed on a circumference of the lid 324, and a flange 3231 fitting in with a dimension of the lodging part 3241 is disposed on a circumference of the cap body 323. The opening 321 can be closed partially or wholly by the lid 324, and herein the opening 321 closed partially by the lid 324 is illustrated in this embodiment. The numbers and the shapes of the connecting unit 322 are not limited and can be adjusted according to the arrangement of the cap body 323 and the lid 324. For example, if the opening 321 is closed wholly by the lid 324, the connecting unit 322 can be directly disposed on the lid 324, which is not shown in the figure. If the opening 321 is closed partially by the lid 324, this embodiment adopts that the container 3 can have multiple connecting units 322, e.g. two connecting units 322 as an example, disposed on the cap 32. Namely, this embodiment has the connecting units 322 convexly disposed on the cap body 323 and the lid 324, respectively. Therefore, the cap 32 provides two symmetric connecting units 322*a*, 322*b* as shown in FIGS. 5 and 6. Alternatively, as shown in FIG. 7, the cap 32 has the connecting unit 322 shaped into an extended convex face to be convexly disposed thereon for making sure the bottom 313*a* of the exhibiting container 3*a* can be positioned and piled more firmly onto the cap 32*b* on the bottle 31*b* of the other exhibiting container 3*b* (as shown in FIG. 9).

Referring to FIGS. 4 and 5, in use, fasteners (not shown) are placed into the exhibiting container 3 first, and users grasp the exhibiting container 3 easily with hands by holding the holding portion 316, whereby the inconvenience caused by holding the entire bottle 11 of the conventional container 1 is overcome. While piling a plurality of exhibiting containers 3*a*, 3*b* up, users embed the connecting unit 322*b* of the lower exhibiting container 3*b* into the lodging zone 317*a* of the upper exhibiting container 3*a*, whereby the exhibiting containers 3*a*, 3*b* are piled and positioned one above another firmly and are not apt to fall off. At the same time, the connecting unit 322*b* in the lower position is embedded into the lodging zone 317*a* in the upper position, so the bottle 31*a* of the upper exhibiting container 3*a* is not blocked off by the cap 32*b* of the lower exhibiting container 3*b* for attaining a whole exhibition of the fasteners stored in the exhibiting container 3*a* and promoting the effects of exhibition and sale.

Referring to FIGS. 4 and 6, while taking out the fasteners stored therein, users impart a force on the lid 324 to separate the lodging part 3241 from the flange 3231 and make the opening 321 of the cap body 323 communicate with the outside. Therefore, users take the fasteners out of the accommodating space 315 from the opening 321 directly, and users need not to take them out by removing the whole cap 32 from the bottle 31 as usual, thereby saving time of taking the fasteners out and preventing the conventional problem of missing the removed cap 32. Therefore, the convenience of use of the exhibiting container 3 is effectively increased. On the other hand, users can press down the lid 324 to lodge the flange 3231 into the lodging part 3241 and thence close the opening 321 for keeping the fasteners in the exhibiting container 3 and for the follow-up piling operation.

Figure 7:
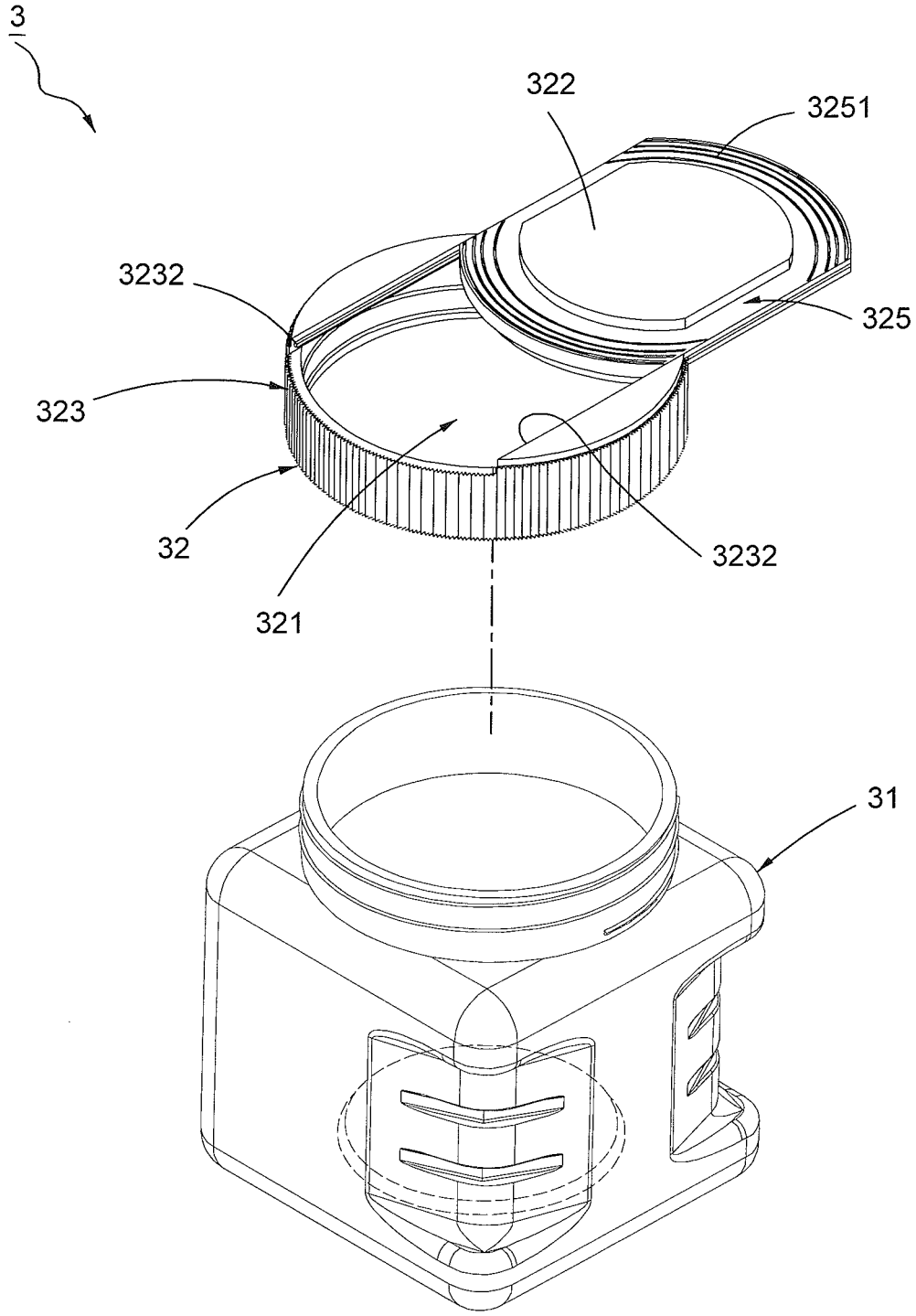
FIG. 7 is a perspective view showing a second preferred embodiment of the present invention.

Referring to FIG. 7, a second preferred embodiment of the exhibiting container 3 for fasteners still comprises a bottle 31 and a cap 32 connected to the bottle 31, the concatenation of correlated elements and the objects thereof are the same as the first embodiment. This preferred embodiment is characterized in that the cap 32 provides a cap body 323 by which the opening 321 is enclosed and a sliding lid 325 is slidably disposed on the cap body 323 for closing the opening 321 and isolating the opening 321 from the outside. Two tracks 3232 are respectively disposed on the cap body 323 for allowing the sliding lid 325 to slide thereon. The connecting unit 322 is convexly disposed on a top surface of the sliding lid 325. Further in this embodiment, a stopping unit 3252 (as shown in FIG. 8) can be disposed on a bottom surface of the sliding lid 325, and a plurality of auxiliary grooves 3251 can also be disposed on the top surface of the sliding lid 325 for increasing the friction between hands and the sliding lid 325.

Figure 8:
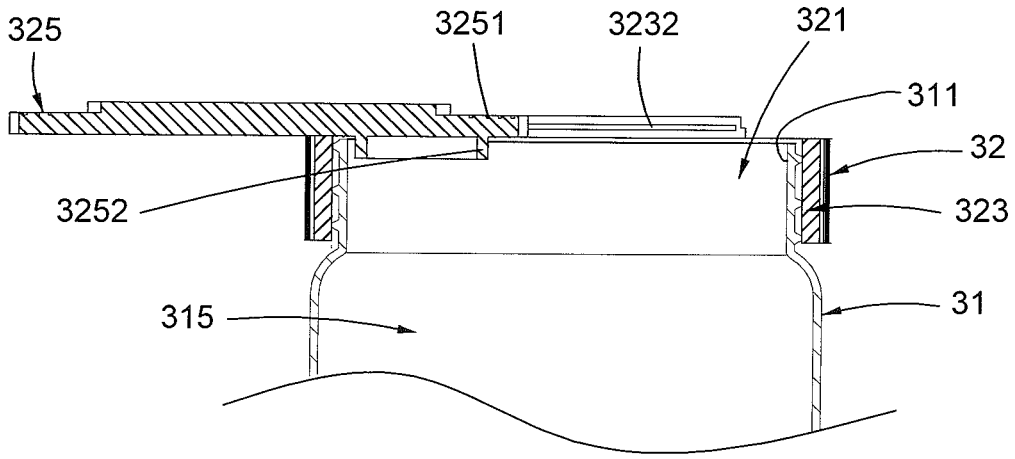
FIG. 8 is a schematic view showing the second preferred embodiment of the present invention with its sliding lid being opened.

Referring to FIG. 8, while taking out the fasteners, users place the fingers on the auxiliary grooves 3251 and impart a pushing force by the aforementioned friction to move the sliding lid 325 along the tracks 3232 and open the opening 321, whereby the fasteners (not shown) stored in the accommodating space 315 can be easily taken out from the opening 321. The sliding lid 325 keeps moving until the stopping unit 3252 disposed at the bottom surface touches an inner wall of the top 311 of the bottle 31, thereby preventing the sliding lid 325 from being over slid and thence moved away from the cap body 323 incautiously due to an overlarge pushing force. In addition, referring to FIG. 9, this embodiment can be piled in the same way as the exhibiting containers 3*a*, 3*b* shown in the first embodiment. Namely, the connecting unit 322*b* of the sliding lid 325*b* on the bottle 31*b* of the exhibiting container 3*b* is embedded into the lodging zone

Figure 10:
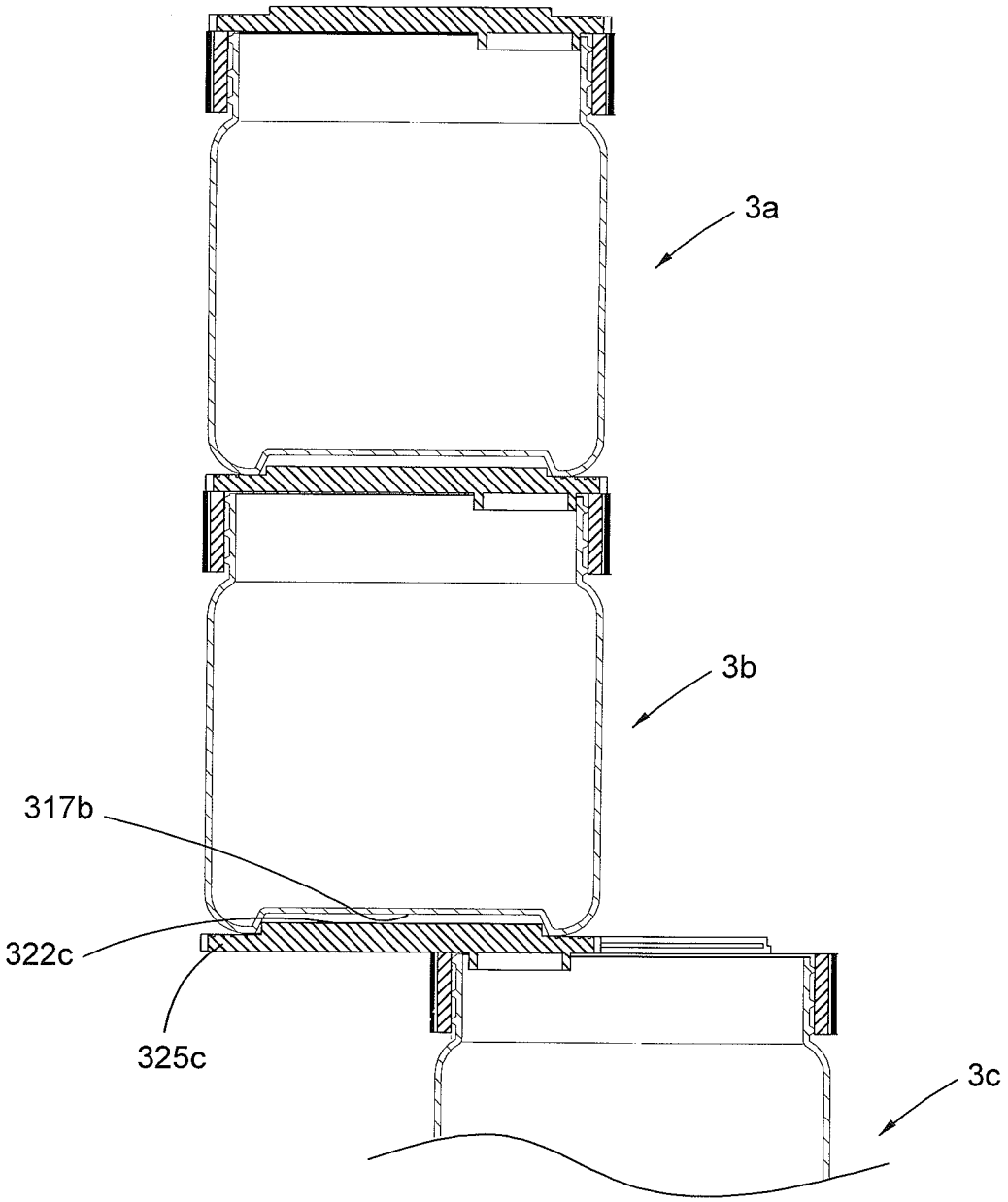
FIG. 10 is a schematic view showing the second preferred embodiment of the present invention in a state of being piled up and the sliding lid of one of the containers opened.

317*a* of the exhibiting container 3*a*, whereby the exhibiting containers 3*a*, 3*b* are piled and positioned firmly, and the inside fasteners are exhibited entirely. Especially, because the connecting unit 322*c* of the exhibiting container 3*c* as shown can have a bigger area to be embedded into the lodging zone 317*b* of the exhibiting container 3*b*, users can push the sliding lid 325*c* of the exhibiting container 3*c* without removing the upper containers 3*a*, 3*b* to take out the fasteners stored in the exhibiting container 3*c* directly (as shown in FIG. 10), which facilitates an increase of the convenience of use.

To sum up, the exhibiting container for fasteners mainly comprises at least one holding portion formed on the outer circumference of the body portion, a lodging zone recessed into the bottom of the bottle, an opening formed on the cap and communicating with the outside and the accommodating space, and at least one connecting unit convexly disposed on the cap for cooperating with the lodging zone. Therefore, the present invention allows the containers to be held easily and allows a plurality of exhibiting containers to be piled and positioned one above another firmly without being blocked off with each other, thereby attaining an entire exhibition of the inside fasteners. Further, users can take the fasteners out of the exhibiting container from the opening directly and simply, whereby the convenience of the use is effectively increased.

While embodiments in accordance with the present invention have been shown and described, it should be clear to those skilled in the art that further embodiments may be made without departing from the scope of the present invention.

What is claimed is:

1. An exhibiting container for fasteners comprising a bottle and a cap connected to said bottle; wherein said bottle includes a top, a body portion connected to said top, a bottom connected to said body portion, a mouth enclosed by said top of said bottle, and an accommodating space formed in an interior of said body portion and communicating with said mouth, whereby fasteners are stored in said accommodating space, with said cap connected to said top of said bottle and set at said mouth, wherein said accommodating space is opened or closed according to an operation of said cap; wherein the cap includes a cap body and a sliding lid; wherein at least one holding portion is formed on an outer circumference of said body portion for hands to hold, with a lodging zone recessed into said bottom of said bottle, with an opening formed in said cap body for communicating with said mouth and an outside, wherein said cap includes said cap body by which said opening is enclosed, with the sliding lid slidably disposed on said cap body for closing said opening and isolating said opening from said outside, with two tracks respectively disposed on said cap body for allowing said sliding lid to slide thereon, at least one connecting unit convexly disposed on said cap for inserting into said lodging zone, with said at least one connecting unit convexly disposed on a top surface of said sliding lid, whereby a plurality of said exhibiting containers are piled one above another by embedding said at least one connecting unit of one exhibiting container into said lodging zone of another exhibiting container, which allows said bottom of said bottle of said one exhibiting container to be firmly positioned onto said cap of said other exhibiting container and exhibits said bottle of said one exhibiting container as a whole without being blocked off by said cap of said other exhibiting container.

2. The exhibiting container for fasteners as claimed in claim 1, wherein said sliding lid provides a plurality of auxiliary grooves formed on said top surface thereof.

3. The exhibiting container for fasteners as claimed in claim 1, wherein a stopping unit is disposed at a bottom surface of said sliding lid.

* * * * *